United States Patent [19]

Nishimura et al.

[11] Patent Number: 4,459,961

[45] Date of Patent: Jul. 17, 1984

[54] FUEL INJECTION CONTROL METHOD

[75] Inventors: Hiroyuki Nishimura, Konosu; Shumpei Hasegawa, Niiza; Masahiro Watanabe, Sagamihara; Takehiko Hosokawa, Yokohama, all of Japan

[73] Assignees: Honda Giken Kogyo Kabushiki Kaisha, Tokyo; Matsushita Electric Industrial Co., Ltd., Osaka, both of Japan

[21] Appl. No.: 348,428

[22] Filed: Feb. 12, 1982

[30] Foreign Application Priority Data

Feb. 17, 1981 [JP] Japan ..... 56-22579

[51] Int. Cl.[3] ..... F02M 51/00

[52] U.S. Cl. ..... 123/491; 123/478

[58] Field of Search ..... 123/179 L, 478, 490, 123/491

[56] References Cited

U.S. PATENT DOCUMENTS

| | | | |
|---|---|---|---|
| 3,587,536 | 6/1971 | Inoue et al. | 123/490 |
| 3,699,932 | 10/1972 | Aono et al. | 123/490 |
| 3,923,031 | 12/1975 | Keraner | 123/491 X |
| 4,020,802 | 5/1977 | Hattori et al. | 123/490 |
| 4,134,368 | 1/1979 | Hadley | 123/491 X |

FOREIGN PATENT DOCUMENTS

| | | | |
|---|---|---|---|
| 2037458 | 7/1980 | United Kingdom | 123/491 |

*Primary Examiner*—Parshotam S. Lall
*Assistant Examiner*—W. R. Wolfe
*Attorney, Agent, or Firm*—Stevens, Davis, Miller & Mosher

[57] ABSTRACT

In a fuel injection control method in which the injector is activated for fuel injection dependent on the interrelation between pulses produced from a crank angle sensor and a timing sensor, all the injectors are activated by any timing pulse before the injector to be normally activated for the fuel injection is determined during start-up of an engine, so that start-up characteristics of the engine can be improved.

6 Claims, 4 Drawing Figures

WITH FOUR-CYLINDER ENGINE, FOR N = 1

WITH FOUR-CYLINDER ENGINE, FOR N = 1

FUEL INJECTION CONTROL METHOD

This invention relates to a fuel injection control method and more particularly to a method of controlling fuel injection in automobile engines.

An electronic fuel injection control system has hitherto been known wherein an injector is mounted to each cylinder, the amount of injecting fuel is computed on the basis of information regarding the engine speed, the output of an intake manifold pressure sensor and the like parameter, and a fuel injection control signal is sequentially applied to each injector at a predetermined timing to thereby inject the fuel into the cyliner.

Typically, the electronic fuel injection control system of this type comprises various sensors such as a timing sensor adapted to sequentially generate timing pulses (for starting the fuel injection) in accordance with rotation of the engine crank shaft, a crank angle sensor (cylinder discriminating sensor) adapted to generate crank angle pulses (cylinder discriminating pulses) at specified crank angles during two rotations of the crank shaft (within a crank angle of 720°), the intake manifold pressure sensor, an intake air temperature sensor, a coolant temperature sensor and a throttle position sensor, a controller comprised of a CPU, RAMs, ROMs, A/D converter and input/output interfaces, and injectors mounted to respective cylinders of the engine.

Figure 1:
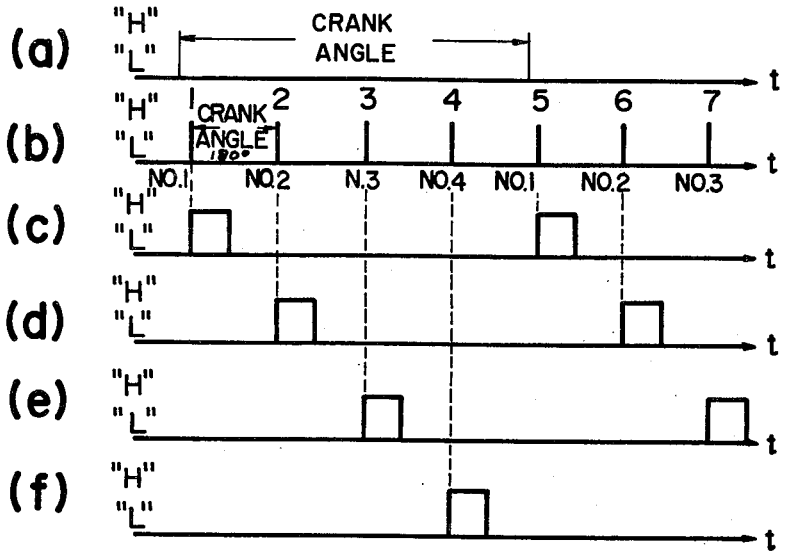
FIG. 1 illustrates in sections (a) through (f) a fuel injection timing chart in accordance with a prior art fuel injection control method.

Referring to FIG. 1, the operation of the electronic fuel injection control system of the type set forth above, especially adapted for four-cylinder engines will be described.

The crank angle sensor produces outputs or crank angle pulses as shown at section (a) in FIG. 1 at specified crank angles during two rotations (within the crank angle of 720°) of an engine. The timing sensor produces four timing pulses as shown at section (b) in FIG. 1 within the two rotations of the crank shaft. Fuel injection control signals as shown at sections (c), (d), (e) and (f) in FIG. 1 are applied to respective injectors mounted to respective cylinders of the engine to open the injector for fuel injection during "H" level of the fuel injection control signal. The time width for the "H" level of the fuel injection control signal is determined by results of computation in the controller effected on the basis of the information from the various sensors.

As shown in FIG. 1, immediately after the output of the crank angle sensor shown at (a) rises to a "H" level, a timing pulse ① is generated from the timing sensor to cause the fuel injection control signal to be applied to an injector No. 1, followed by the application of the control signal to an injector No. 2 by a subsequent timing pulse ② . Similarly, the fuel injection control signal is sequentially applied to injectors No. 3 and No. ④ by timing pulses ③ and ④ , respectively.

It will be appreciated that in the above fuel injection control method, the crank angle pulses shown at (a) in FIG. 1 are taken as a reference for making correspondence between each of the timing pulses ① , ② , ③ , ④ , .....and each of the injectors. In other words, the timing pulse ① generated immediately after the occurrence of one crank angle pulse is used as a timing pulse ② is used for the injector No. 2. This method, however, entails a problem during start-up of the engine.

More particularly, the accordance with the aforementioned method, the fuel injection control signal may be applied to the injector No. 1 at the timing of the first fuel injection (in response to the first timing pulse ① ) if the output of the crank angle sensor becomes "H" before the first timing pulse ① directly successive to the engine start-up occurs. But, during the engine start-up, if the timing sensor output (timing pulse ① ) occurs before the crank angle sensor output becomes "H", it cannot be determined which injector is to be applied with the fuel injection control signal at the timing of the first fuel injection immediately after the engine start-up.

To eliminate such a problem, it is conceivable to adopt the following expedients (a) and (b) which may be fulfilled before the crank angle sensor output occurs, that is to say, before the injector to be applied with the fuel injection control signal at each of the injection timings is determined.

(a) Delivery of the fuel injection control signal is prevented.

(b) On the assumption that the timing sensor input immediately after the engine start-up is produced at the timing of fuel injection for, for example, the injector No. 1, control signals for the injectors No. 2, No. 3 and No. 4 are sequentially generated at the timing of occurrence of the succeeding timing sensor outputs and once the crank angle sensor output occurs, the normal sequence of application of the control signal to the No. 1, No. 2, No. 3, No. 4, No. 1 ..... injectors is recovered to sequential apply the control signal to the injectors in this orderly manner.

According to the expedient (a), however, it happens in the worst case that none of the fuel injection is effected through 720° crank angle or during two rotations of the crank shaft, thus impairing start-up characteristics of the engine. Also, in the expedient (b), it happens that the fuel injection control signal is applied to, for example, a series of No. 1, No. 2, No. 1, No. 2, No. 3 ..... injectors with the result that the fuel injection into cylinders associated with the No. 1 and No. 2 injectors becomes excessive, also resulting in impairment of start-up characteristics of the engine.

It is therefore an object of this invention to eliminate the above drawbacks. The invention will now be described by way of example with reference to FIG. 3.

Figure 2:
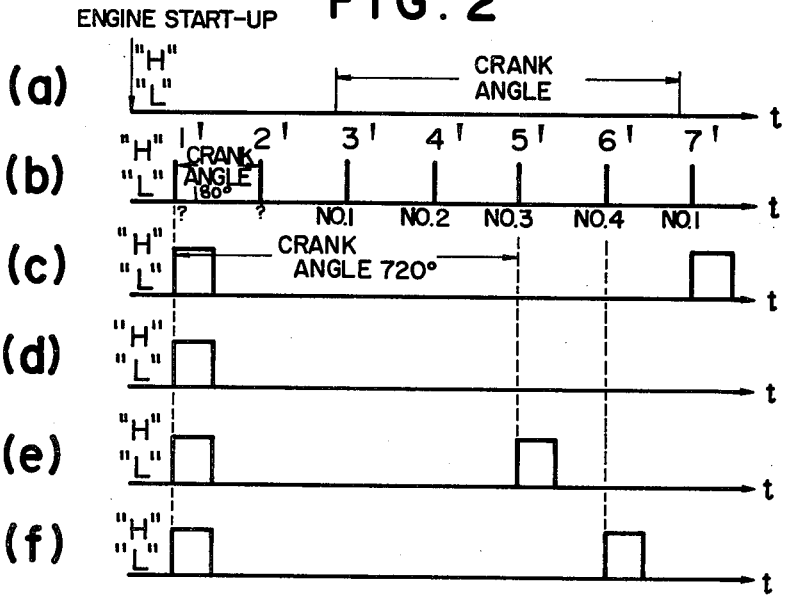
FIG. 2 illustrates in sections (a) through (f) a fuel injection timing chart useful in explaining a fuel injection control method embodying the invention.
Figure 3:
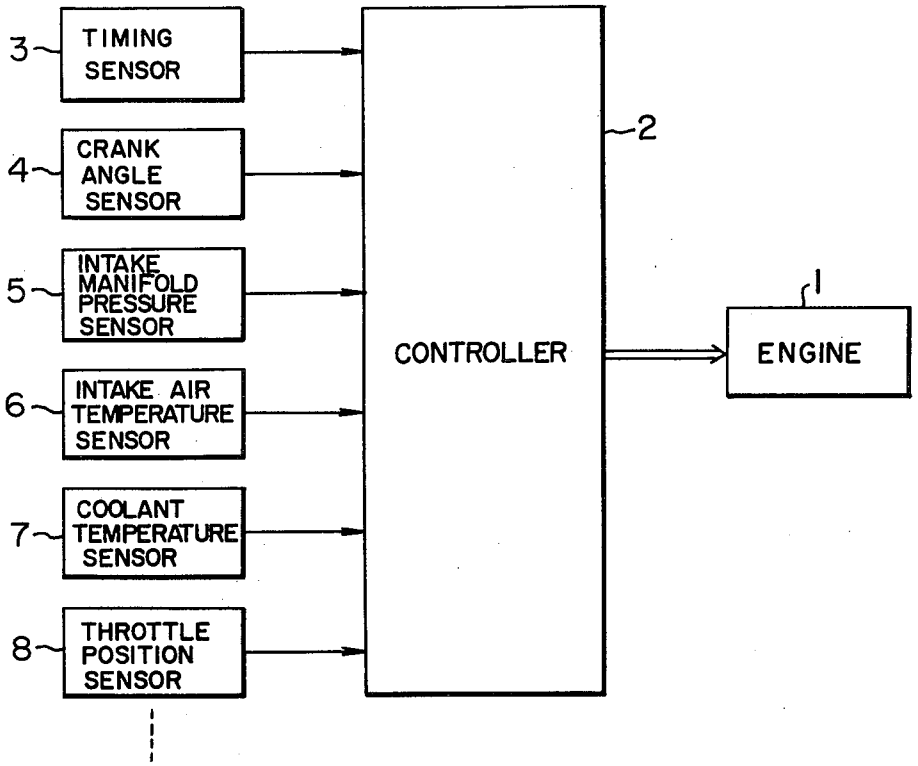
FIG. 3 is a schematic block diagram for implementing the embodiment.

A preferred embodiment of a fuel injection control system according to the invention is schematically illustrated, in block form, in FIG. 3. In the figure, a four-cyclinder engine 1 has cylinders each mounted with an injector, and a controller 2 adapted to compute the amount of injecting fuel in the engine 1 and apply a fuel injection control signal to each of the injectors includes a CPU, RAMs, ROMs, A/D converters and input/output interfaces. A timing sensor 3 generates four timing pulses during two rotations of a crank shaft of the engine 1 as shown at (b) in FIG. 1 and at (b) in FIG. 2, and a crank angle sensor 4 generates pulses at specified crank angles during two rotations of the crank shaft as shown at (a) in FIG. 1 and at (a) in FIG. 2. Denoted by reference numeral 5 is an intake manifold pressure sensor, 6 an intake air temperature sensor, 7 a coolant temperature sensor, and 8 a throttle position sensor. The primary amount of injecting fuel is computed on the basis of infomation regarding the engine speed from the timing sensor 3 and infomation from the intake manifold pressure sensor 5 and it is corrected by information from the intake air temperature sensor 6, coolant temperature sensor 7 and throttle position sensor 8.

With the above construction, this embodiment is adaptted to apply the fuel injection control signals as shown at sections (c) through (f) in FIG. 2 to the repsective injectors when the crank angle sensor output and the timing sensor output, for example, as shown at sections (a) and (b), respectively, are generated.

More particularly, only at the timing of the first fuel injection immediately after the engine startup, a necessary and sufficient amount of fuel is injected from all the injectors to all the associated cylinders and subsequently, after two rotations of the crank shaft have been completed through which each of the cylinders has experienced one ignition and explosion stroke (before this moment, the crank angle sensor output has once assumed the "H" level and it is possible to discriminate the injector to be used for fuel injection at the orderly timing of fuel injection), the sequence of the fuel injection shifts to normal one. However, if the crank angle sensor output becomes "H" before the timing sensor output initially assumes "H" immediately after the engine start-up, the fuel injection may be carried out sequentially in normal order starting from the first fuel injection timing.

Figure 4:
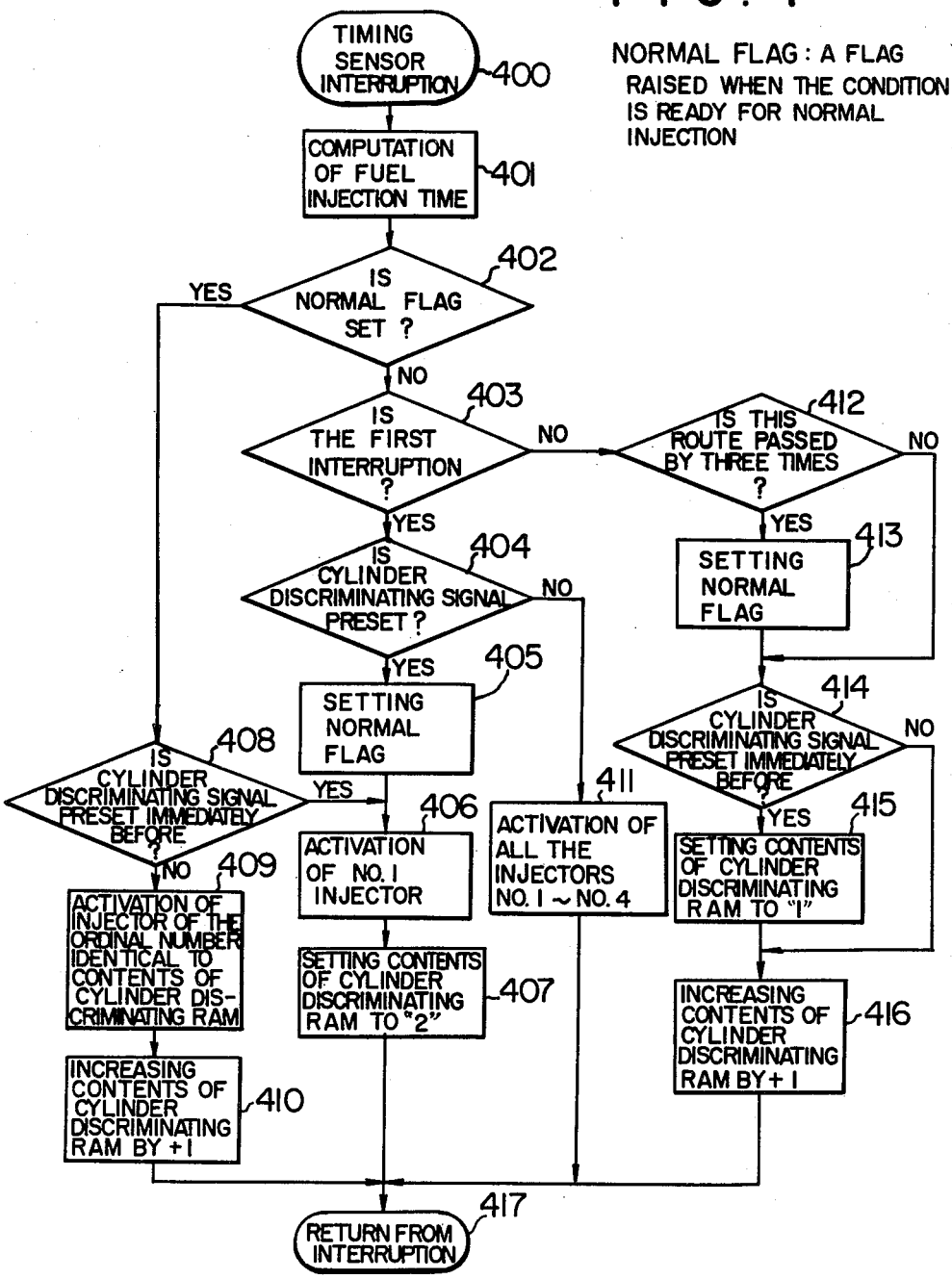
FIG. 4 is a flow chart for implementing the embodiment.

FIG. 4 shows a flow chart for the embodiment as described above. The interruption by the timing pulses ① to ② shown at (b) in FIG. 1 and the timing pulses ①′ to ⑦′ shown in (b) in FIG. 2 is effected as will be described with reference to FIG. 4.

(A) Interrpution in Normal Fuel Injection Process as Shown in FIG. 1

Interruption by timing pulse ①

The interruption starts in step 400. In step 401, the fuel injection time is computed. In step 402, it is judged whether or not a normal flag (raised when the normal injection is ready for starting, namely, when the cylinder discriminating signal occurs immediately before occurence of the timing pulse is set. At the timing of the timing pulse ①, the normal flag is not set and "No" is issued. In step 403, it is judged whether or not the first interruption is effected, and "Yes" is issued. In step 404, judgment is effected as to whether or not the cylinder discriminating signal (crank angle sensor output) is present immediately before the timing pulse ① and "Yes" is issued. The normal flag is then set in step 405. In step 406, the injector No. 1 is activated. In step 407, contents of a cylinder discriminating RAM are set to "2" and the processing proceeds to step 417.

Interruption by timing pulse ②

The processing proceeds from step 400 to step 408 via steps 401 and 402 with issuance of "Yes" in step 402. In step 408, judgment is effected as to whether or not the cylinder discriminating signal is present immediately before the timing pulse ② and "No" is issued. In step 409, the injector coincident with the contents of the clinder discriminating RAM, that is, the injector No. 2 is activated. The contents of the cylinder discriminating RAM is then increased by "+1" in step 410 and the processing proceeds to step 417.

Interruption by timing pulse ③

In processing proceeds from step 400 to step 417 via steps 401, 402, 408, 409, and 410 with the injector No. 3 being activated in step 409.

Interruption by timing pulse ④

The processing proceeds from step 400 to step 417 via steps 401, 402, 408, 409 and 410 with the injector No. 4 being activated in step 409.

Interruption by timing pulse ⑤

The processing proceeds from step 400 to step 417 via steps 401, 402, 408, 406, and 407 with issuance of "Yes" in step 408 and activation of the injector No. 1 in step 406.

Interruption by timing pulse ⑥

The processing proceeds from step 400 to step 417 via steps 401, 402, 408, 409 and 410 with activation of the injector No. 2 in step 409.

Interruption by timing pulse ⑦

The processing proceeds from step 400 of step 417 via steps 401, 402, 408, 409, and 410 with activation of the injector No. 3 in step 409.

(B) Interruption in Egine Start-up Process as shown in FIG. 2

Interruption by timing pulse ①′

The processing proceeds from step 400 to step 404 via steps 401, 402, and 403. In step 404, it is judged whether or not the cylinder discriminating signal is present immediately before the timing pulse ①′ and "No" is issued. In step 411, all the injector No.s 1 to 4 are activated and the processing, ends in step 417.

Interruption by timing pulse ②′

The processing proceeds from step 400 to step 403 via steps 401 and 402. In step 403, it is judged whether or not the first interruption is effected and "No" is issued. In step 412, judgement is effected as to whether or not the processing is passed through this route three times and "No" is issued. In step 414, judgement is effected as to whether or not the cylinder discriminating signal is present immediately before the timing pulse ②′ and "No" is issued. In step 416, contents of the cylinder discriminating RAM are increased by "+1" and the processing ends in step 417.

Interruption by timing pulse ③′

The processing proceeds from step 400 to step 414 via steps 401, 402, 403, and 412. In step 414, "Yes" is issued and in step 415, the contents of the cylinder discriminating RAM are set to "1". The processing then proceeds to step 416 and ends in step 417.

Interruption by timing pulse ④′

The processing proceeds from step 400 to step 417 via steps 401, 402, 403, 412, 413, 414 and 416 with issuance of "Yes" in step 412 and setting of the normal flag in step 413.

Interruption by timing pulse ⑤′

The processing proceeds from step 400 to step 417 via steps 401, 402, 408, 409 and 410 with activation of the injector No. 3 in step 409.

Interruption by timing pulse ⑥′

The processing proceeds from step 400 to step 417 via steps 401, 402, 408, 409 and 410 with activation of the injector No. 4 in step 409.

Interruption by timing pulse ⑦′

The processing proceeds from step 400 to step 417 via steps 401, 402, 408, 406 and 407 with activation of the injector No. 1 in step 406.

The timing for the fuel injection from all the injectors following the engine start-up may be shifted from the first fuel injection timing as in the foregoing embodiment to the second or ensuring fuel injection timing.

While in the foregoing embodiment the normal fuel injection is carried out independently by the separate injectors (cylinders), the invention may be applicable to a case wherein the injector Nos. 1 and 2 and the injector Nos. 3 and 4 are ganged into two groups, and the injectors in each group are activated simultaneously and the two groups are activated at an interval corresponding to a crank angle of 360°. Further, the invention may obviously be applicable to engines other than the four-cylinder engine.

As has been described, the present invention provides the fuel injection control method wherein the fuel injection is not effected until (N−1) fuel injection timing following the engine start-up, the necessary and sufficient amount of fuel is injected into all the cylinders from all the injectors at the N-th fuel injection timing, the fuel injection is not effected between the (N+1)-th66 and N+(M−1)-th fuel injection timings, and the fuel injection is effected sequentially in the normal order and processing at the (N-M)-th and subsequent fuel injection timings, whereM represents the number of fuel injection timings during two rotations of the crank shaft and it amounts to 4 when the injectors of the four-cycle engine are activated sequentially and seperately and 2 when the injectors of the four-cycle engine are ganged into two groups and the injectors in each group are activated simultaneously, and N represents an integer which is not greater than M. This control method can be implemented with a microcomputer by altering only the program for the microcomputer without necessitating alternation of hardware such as the circuit construction to thereby readily improve the start-up characteristics of the engine.

What is claimed is:

1. A method of controlling fuel injection adapted for a fuel injection control system comprising:

a crank angle sensor for generating crank angle pulses at specified crank angles during a plurality of rotations of a crank shaft of an engine having a plurality of cylinders;

a timing sensor for sequentially generating timing pulses between the crank angle pulses;

a plurality of injectors respectively mounted to each of the cylinders of the engine; and a controller for computing a fuel injection time for each of the injectors upon being interrupted by each of the timing pulses and controlling the fuel injection timing for each of the injectors, said controlling method being such that fuel is injected from all the injectors by only the N-th timing pulse before the (N+M−1)-th timing pulse occurs following start-up of the engine, where N is an integer not greater than M and M represents the number of fuel injection timings during two rotations of the crank shaft, and the fuel is injected from the injectors specified by the crank angle pulses and the timing pulses after the (N+M)−th timing pulse occurs.

2. A fuel injection control method according to claim 1, wherein when the injector to be specified by the crank angle pulse and the timing pulse is determined before the N-th timing pulse occurs following the engine start-up, the fuel is injected from the injectors normally corresponding to the timing pulses by the N-th and subsequent timing pulses.

3. A method of controlling fuel injection adapted for a fuel injection control system comprising:

a crank angle sensor for generating crank angle pulses at specified crank angles during a plurality of rotations of a crank shaft of an engine having a plurality of cylinders;

a timing sensor for sequentially generating M timing pulses between the crank angle pulses;

a plurality of injectors respectively mounted to each of the cylinders of the engine; and a controller for computing a fuel injection time for each of the injectors by the interruption by each of the timing pulses and controlling the fuel injection timing for each of the injectors, said controlling method being such that it is judged during the interruption processing by the timing pulse following start-up of the engine whether or not the crank angle pulse is present immediately before the timing pulse, and all the injectors are activated simultaneously by any timing pulse occuring at the time when it is determined that the crank angle pulse is absent immediately before the timing pulse.

4. A fuel injection control method according to claim 3, wherein the interruption processing by the timing pulse comprises the steps of:

judging whether or not the interruption is effected by the first timing pulse following the engine start-up;

judging, when the interruption by the first timing pulse is determined, whether or not the crank angle pulse is present immediately before the first timing pulse; and ;p1 activating all the injectors when it is determined that the crank angle pulse is absent immediately before the timing pulse.

5. A fuel injection control method according toclaim 3, wherein the interruption processing by the timing pulse comprises:

a first step of computing the fuel injection time;

a second step of judging whether or not a normal flag indicative of a condition ready for the normal injection is set;

a thrid step of judging, when "No" is issued in the second step, whether or not the first interruption is effected;

a fourth step of judging, when "Yes" is issued in the third step, whether or not the crank angle pulse is present immediately before the timing pulse;

a fifth step of setting the normal flag when "Yes" is issued in the fourth step;

a sixth step of activating the first injector;

a seventh step of setting contents of a cylinder discriminating RAM to "2";

an eighth step of judging, when "Yes" is issued in the second step, whether or not the crank angle pulse is present immediately before the timing pulse and proceeding to the sixth step when "Yes" is issued in the eighth step;

a ninth step of activating the injector of the ordinal number identical with the contents of the cylinder discriminating RAM when "No" is issued in the eighth step;

a tenth step of increasing the contents of thecylinder discriminating RAM by "+1"; and an eleventh step of activating all the injectors simultaneously when "No" is issued in the fourth step.

6. A fuel injection control method according to claim 5, wherein said interruption processing by the timing pulse further comprises:

a twelfth step of judging, when "No" is issued in the third step, whether or not the processing is passed through this route three times;

a thirteenth step of setting the normal flag when "Yes" is issued in the twelfth step;

a fourteenth step of judging, after the thriteenth step of when "No" is issued in the twelfth step, whether or not the crank angle pulse is present immediately before the timing pulse;

a fifteenth step of setting the contents of the cylinder discriminating RAM to "1" when "Yes" is issued in the fourteenth step; and a sixteenth step of increasing, after the fifteenth step or when "No" is issued in the fourteenth step, the contents of the cylinder discriminating RAM by "+1".

* * * * *